US007950073B2

(12) United States Patent
Ferrara

(10) Patent No.: US 7,950,073 B2
(45) Date of Patent: May 31, 2011

(54) HEADGEAR SECUREMENT SYSTEM

(75) Inventor: Vincent R. Ferrara, Wellesley, MA (US)

(73) Assignee: Xenith, LLC, Lowell, MA (US)

( * ) Notice: Subject to any disclaimer, the term of this patent is extended or adjusted under 35 U.S.C. 154(b) by 261 days.

(21) Appl. No.: 12/104,522

(22) Filed: Apr. 17, 2008

(65) Prior Publication Data

US 2009/0038055 A1 Feb. 12, 2009

Related U.S. Application Data

(60) Provisional application No. 60/954,167, filed on Aug. 6, 2007.

(51) Int. Cl.

| | |
|---|---|
| ***A42B 1/22*** | (2006.01) |
| ***A42B 1/06*** | (2006.01) |
| ***A42B 3/00*** | (2006.01) |

(52) U.S. Cl. ..... 2/417; 2/410; 2/411; 2/412; 2/413; 2/414; 2/418

(58) Field of Classification Search ..... 2/410, 5, 2/6.1, 6.6, 6.8, 411, 412, 413, 414, 415, 416, 2/417, 418, 419, 420, 421, 422, 425, DIG. 10; D29/102, 103

See application file for complete search history.

(56) References Cited

U.S. PATENT DOCUMENTS

| | | | | |
|---|---|---|---|---|
| 1,835,883 | A * | 12/1931 | Lewis | 2/412 |
| 3,028,602 | A * | 4/1962 | Miller | 2/6.1 |
| 3,087,166 | A * | 4/1963 | Howard | 2/420 |
| 3,167,069 | A * | 1/1965 | Lobelle | 128/201.24 |
| 3,289,212 | A | 12/1966 | Morgan | |
| 3,943,572 | A * | 3/1976 | Aileo | 2/415 |
| 4,642,814 | A * | 2/1987 | Godfrey | 2/462 |
| 4,884,301 | A * | 12/1989 | Aileo | 2/421 |
| 5,142,705 | A * | 9/1992 | Edwards | 2/418 |
| 5,315,718 | A * | 5/1994 | Barson et al. | 2/418 |
| 5,361,416 | A * | 11/1994 | Petrie et al. | 2/171.2 |
| 5,572,749 | A * | 11/1996 | Ogden | 2/421 |
| 5,575,017 | A * | 11/1996 | Hefling et al. | 2/418 |
| 5,815,847 | A * | 10/1998 | Holden, Jr. | 2/418 |
| 5,953,761 | A * | 9/1999 | Jurga et al. | 2/425 |

(Continued)

FOREIGN PATENT DOCUMENTS

DE 33 25 250 A1 1/1985

(Continued)

OTHER PUBLICATIONS

"Notification of Transmittal of the International Search Report and the Written Opinion of the International Searching Authority, or the Declaration", International Application No. PCT/US2008/009373, published by European Patent Office, Mail Date Nov. 18, 2008, 15 pages.

*Primary Examiner* — Gary L Welch
*Assistant Examiner* — Jane S Yoon
(74) *Attorney, Agent, or Firm* — Bingham McCutchen LLP

(57) ABSTRACT

Headgear of the type having an outer layer and a relatively flexible inner layer includes a belt which extends around the inner layer within the outer layer, and a tensioning device which can tension the belt causing the belt to urge the inner layer inward away from the outer layer and against the helmet wearer's head. Preferably, the tensioning device includes a chinstrap assembly releasably fastened to the front of the helmet.

20 Claims, 5 Drawing Sheets

U.S. PATENT DOCUMENTS

| | | | | |
|---|---|---|---|---|
| 6,189,156 | B1 * | 2/2001 | Loiars | 2/424 |
| 6,256,798 | B1 * | 7/2001 | Egolf et al. | 2/421 |
| 6,865,752 | B2 * | 3/2005 | Udelhofen et al. | 2/425 |
| 7,152,253 | B2 * | 12/2006 | Abelman et al. | 2/421 |
| 2004/0003452 | A1 * | 1/2004 | Schiebl | 2/421 |
| 2006/0096011 | A1 | 5/2006 | Dennis et al. | |

FOREIGN PATENT DOCUMENTS

| | | | |
|---|---|---|---|
| EP | 0 527 308 | A | 2/1993 |
| EP | 1 472 943 | A | 11/2004 |
| WO | WO 2006/089098 | A1 | 8/2006 |

* cited by examiner

HEADGEAR SECUREMENT SYSTEM

CROSS-REFERENCE TO RELATED APPLICATIONS

The present application claims the benefit of U.S. Provisional Application Ser. No. 60/954,167, filed Aug. 6, 2007, the contents of which are hereby incorporated by reference herein.

BACKGROUND OF THE INVENTION

1. Field of the Invention

This invention relates to protective headgear. It relates more specifically to a headgear securement system for effectively fitting headgear such as a helmet to a wearer's head.

2. Background Information

Protective headgear such as a helmet is used widely in games and other physical activities to help protect the wearer from head injury. Head injury can result from impact forces due to contact with other people or with objects. Currently marketed helmets generally fall into one of two categories, i.e. single impact helmets or multiple impact helmets. Single impact helmets undergo permanent deformation under impact, whereas multiple impact helmets are capable of withstanding multiple blows. The wearers of single impact helmets include, for example, bicyclists and motorcyclists. On the other hand, participants in sports such as hockey and football generally wear multiple impact helmets. Both categories of helmets have similar constructions which include a semi-rigid outer shell which distributes the force of an impact over a wide area, a crushable layer inside the shell which reduces the force of the impact on the wearer's head and usually also an inner liner that helps to shape the helmet to the wearer's head.

Nearly all helmets provide some sort of device for securing the helmet to the wearer's head. Many of these devices involve a chinstrap assembly designed to retain the helmet on the user's head and to protect the user's chin from the force of an impact. Typically such chinstrap assemblies include a chin protector and an adjustable chinstrap which connects the chin protector to the helmet at opposite sides of the helmet's face opening. The length of the chinstrap may be adjusted to draw down and seat the helmet on the user's head and to place the chin protector against the chin. In other words, the strap assembly simply adjusts the distance between the chin protector and the helmet.

Thus, the prior chinstrap assemblies do nothing to affect the helmet in any way so that it more closely conforms to the shape of the wearer's head. No attempt is made to use the chinstrap assembly as a means to alter the helmet to achieve an optimal fit for a particular wearer. This is most likely due to the fact that most conventional helmets are not particularly accommodating to a variety of different head shapes and sizes.

However, there has already been developed by me a class of protective headgear incorporating a plurality of energy-absorbing layers. Such headgear is disclosed, for example, in publications WO 2006/089234 and WO 2006/089235. As seen there, these helmets include a semi-rigid outer layer or shell, an inner layer and a middle layer between the outer and inner layers. This middle layer is composed of a plurality of individual compressible cells disposed in a fluid-containing interstitial region formed by the inner and outer layers. At least one passageway is provided by which fluid in the interstitial region and fluid expelled from the cells can leave the middle layer as the outer layer deforms in response to an impact on the helmet.

Preferably, such helmets also include a compressible inner liner whose shape can change to conform to a wearer's head as each helmet is drawn down on the head by an associated chinstrap assembly which includes a chin protector and adjustable chinstraps. Such an arrangement is described in publication WO 2006/089098. As seen there, the straps extending from the chin protector are still connected to corresponding locations at the opposite sides of the helmet outer layer or shell. Therefore, the tightening of the chinstrap has no effect on the physical characteristics of the helmet per se.

SUMMARY OF THE INVENTION

Accordingly, it is an object of the present invention to provide an improved headgear securement system which adapts a helmet to fit the particular shape of the wearer's head.

A further object of the invention is to provide such a system in which a chinstrap assembly coacts with different portions of an associated headgear to conform the headgear to the wearer's head.

Yet another object of the invention is to provide protective headgear, including a helmet and an associated chinstrap assembly, which is particularly adapted to protect the wearer's head from injury.

Other objects will, in part, be obvious and will, in part, appear hereinafter. The invention accordingly comprises the features of construction, combination of elements and arrangement of parts which will be exemplified in the following detailed description, and the scope of the invention will be indicated in the claims.

Briefly, my headgear securement system is especially adapted for use with a helmet having an outer shell or layer, an inner layer and a middle layer interposed between the outer layer and inner layer, that middle layer comprising one or more individual impact-absorbing compressible cells. The helmet may also include a conformable inner liner within the inner layer. Preferably, that liner includes a plurality of individual resilient pads or capsules. In effect, these pads form a dynamic inner liner for the multilayered helmet that may be brought into close conformance to the contour of the wearer's head. While the invention will be described in the context of a protective helmet or hat with a rigid outer shell as might be worn by a football player, racecar driver, construction worker or the like, the invention is equally applicable to headgear having a soft outer layer suitable to protect the head of a boxer, soccer player or the like.

The securement system includes an inextensible belt and a belt tensioning device such as a chinstrap assembly which coact with certain layers of the helmet to provide an especially snug and comfortable fit of the helmet to the wearer's head. The belt extends around the inner layer within the outer layer of the helmet and has segments or runs which are slidably supported by one or more of the layers, each belt segment extending to the front of the helmet where it connects to the tensioning device, e.g. a chinstrap assembly.

The chinstrap assembly may include a chin protector and a pair of straps having corresponding first ends connected to the opposite ends of the belt and corresponding second ends that pass through opposite ends of the chin protector. The straps loop back toward the outer layer of the helmet and they may be releasably fastened to retain the positions of the system components.

The aforesaid straps may be extensions of the belt. More preferably, the belt comprises a separate, flexible loop having spaced-apart upper and lower runs which are slidable relative to the flexible helmet inner layer. The lengths of these runs are such that the ends of the loop are located on opposite sides of the helmet near the helmet face opening, with the first ends of the aforesaid straps being connected to opposite ends of the loop.

After donning the helmet, the wearer may pull on the free, second ends of the straps so as to draw the chin protector against the wearer's chin. This action also, by way of the belt, snugs the helmet inner layer and liner around the wearer's head. When a suitable fit of the helmet and chin protector to the wearer's head has been achieved, the second ends of the two straps may thereafter be fastened to the helmet outer layer or some other anchor thereby stabilizing the system.

To remove the helmet from his head, the wearer may unfasten one or both straps and pull the helmet away from his head.

BRIEF DESCRIPTION OF THE DRAWINGS

For a fuller understanding of the nature and objects of the invention, reference should be made to the following detailed description taken in connection with the accompanying drawings, in which.

DETAILED DESCRIPTION OF ILLUSTRATIVE EMBODIMENTS

Figure 1:
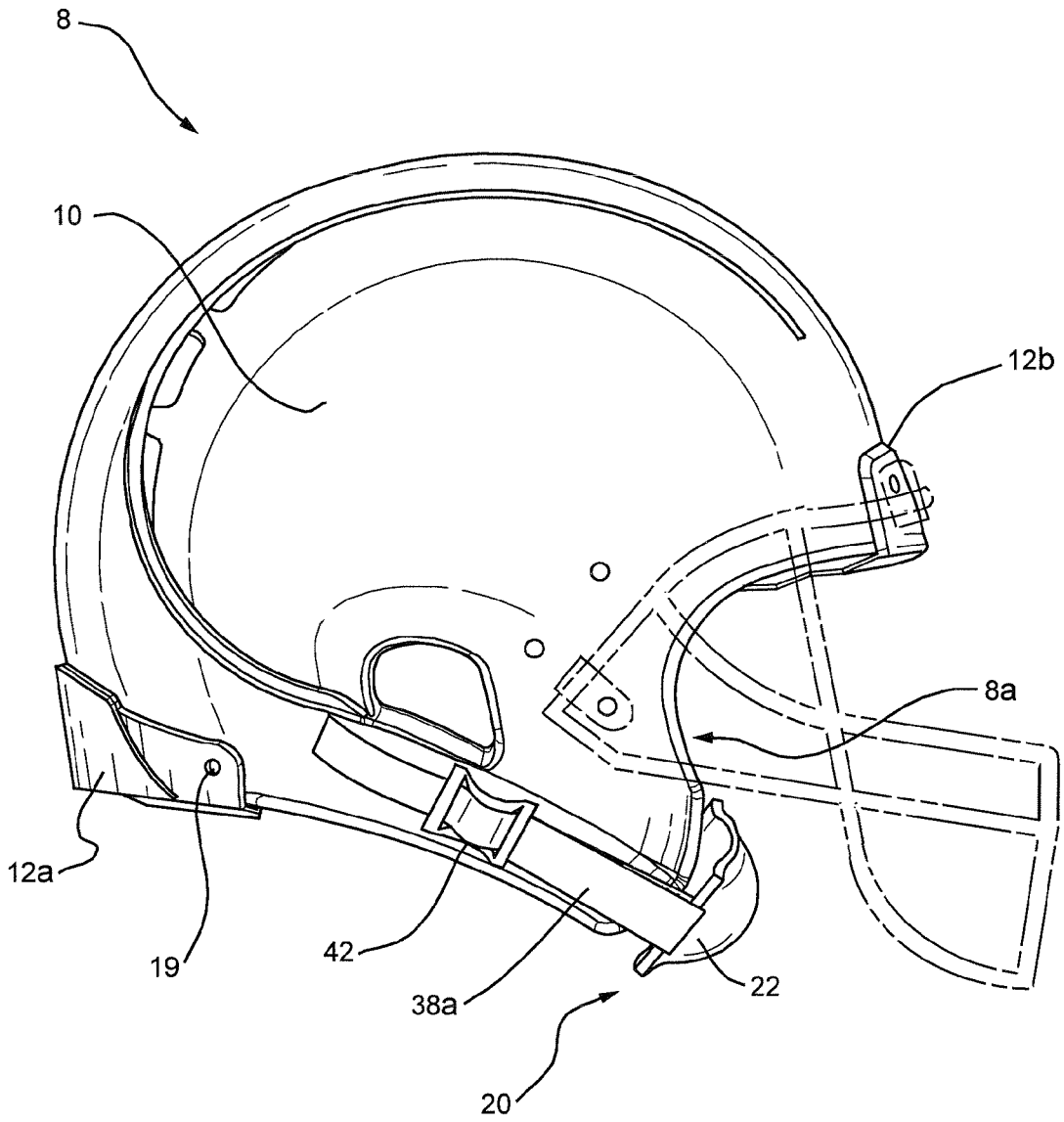
FIG. 1 is a side elevational view of a football helmet incorporating my invention.
Figure 2:
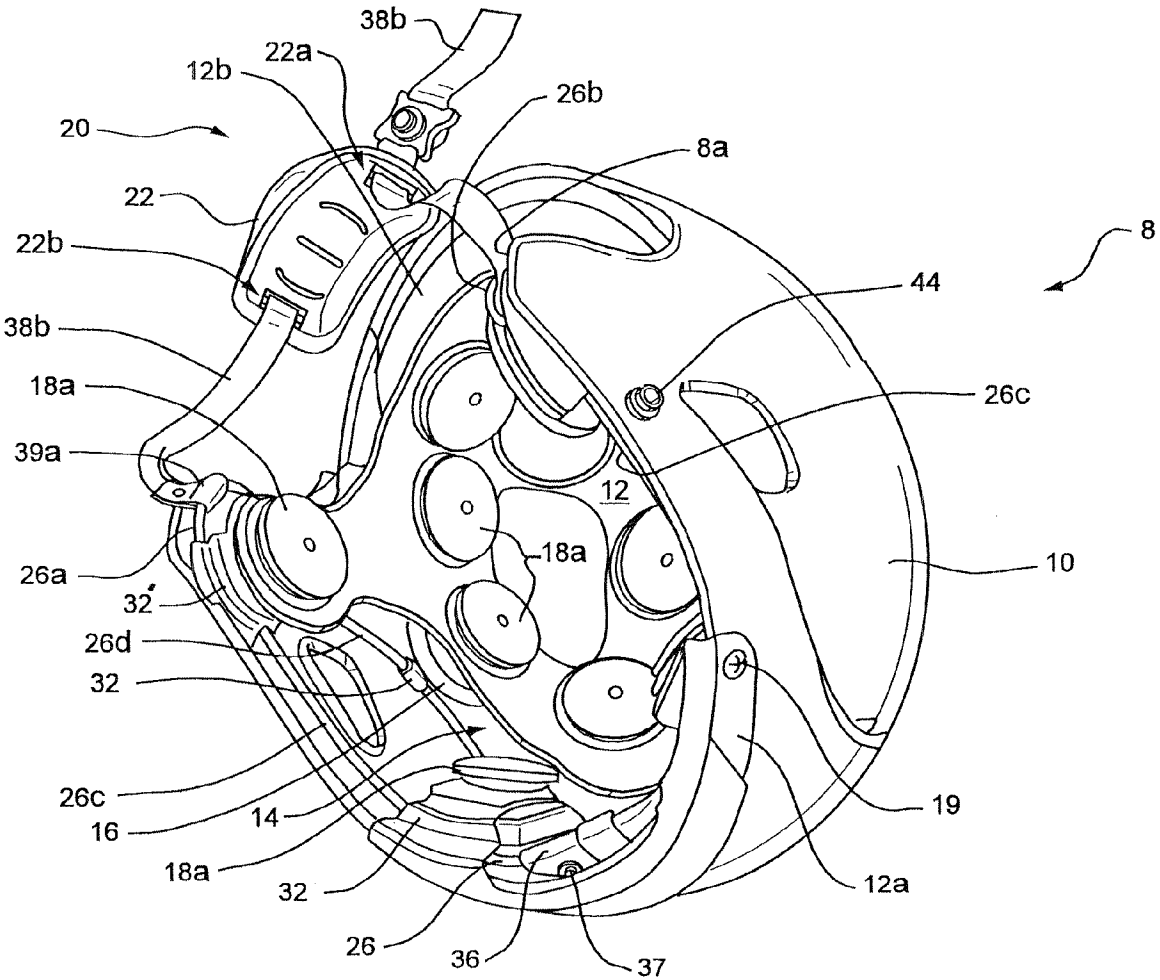
FIG. 2 is an isometric view of the FIG. 1 helmet viewed from below.

Referring to FIGS. 1 and 2 of the drawings, my headgear securement system is especially applicable for use with a helmet shown generally at 8 which has a semi-rigid outer layer 10 and a flexible inner layer or bonnet 12 which may be of a softer, less rigid material.

The helmet 8 may also include a third, middle, layer 14 between the outer and inner layers 10 and 12. Layer 14 comprises an interstitial region between layers 10 and 12 containing a plurality of compressible cells 16 which extend between the inner and outer layers and which may be releasably secured to the inner layer. Preferably helmet 8 also has a compressible, conformable inner liner 18 composed of a plurality of resilient pads or capsules 18*a* which are connected to cells 16 and project from the interior surface of the inner layer 12. A helmet such as this is described in more detail in my co-pending application Ser. No. 11/689,541, filed Mar. 22, 2007, the entire contents of which are hereby incorporated herein by reference.

Figure 6:
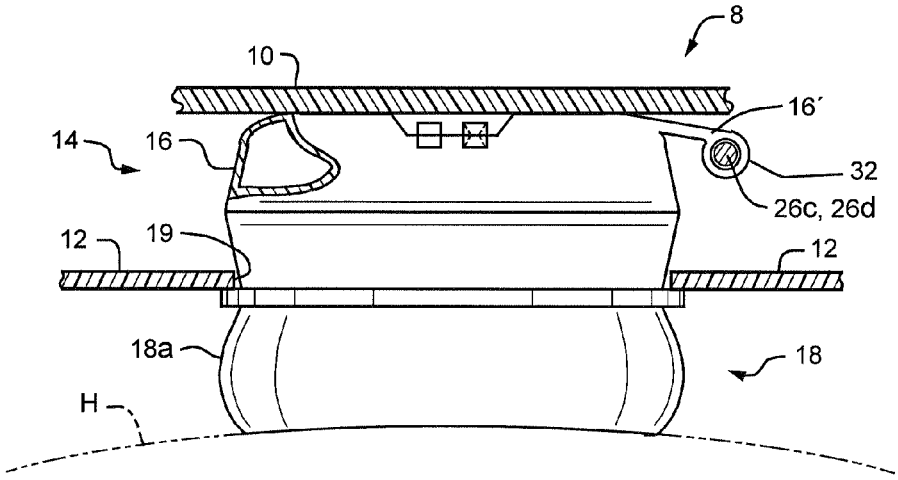
FIG. 6 is a fragmentary sectional view on a much larger scale showing the helmet layers in greater detail.

In the illustrated helmet, the inner layer 12 is a flexible molded plastic structure which includes a rear flange 12*a* that extends up around the outside of shell 10 and is secured thereto by fasteners 19. A comparable flange 12*b* at the front of layer 12 is similarly fastened to the shell 10 above face opening 8*a*. The cells 16 and pads 18*a* are secured within openings 19 in layer 12 as shown in FIG. 6.

Figure 3:
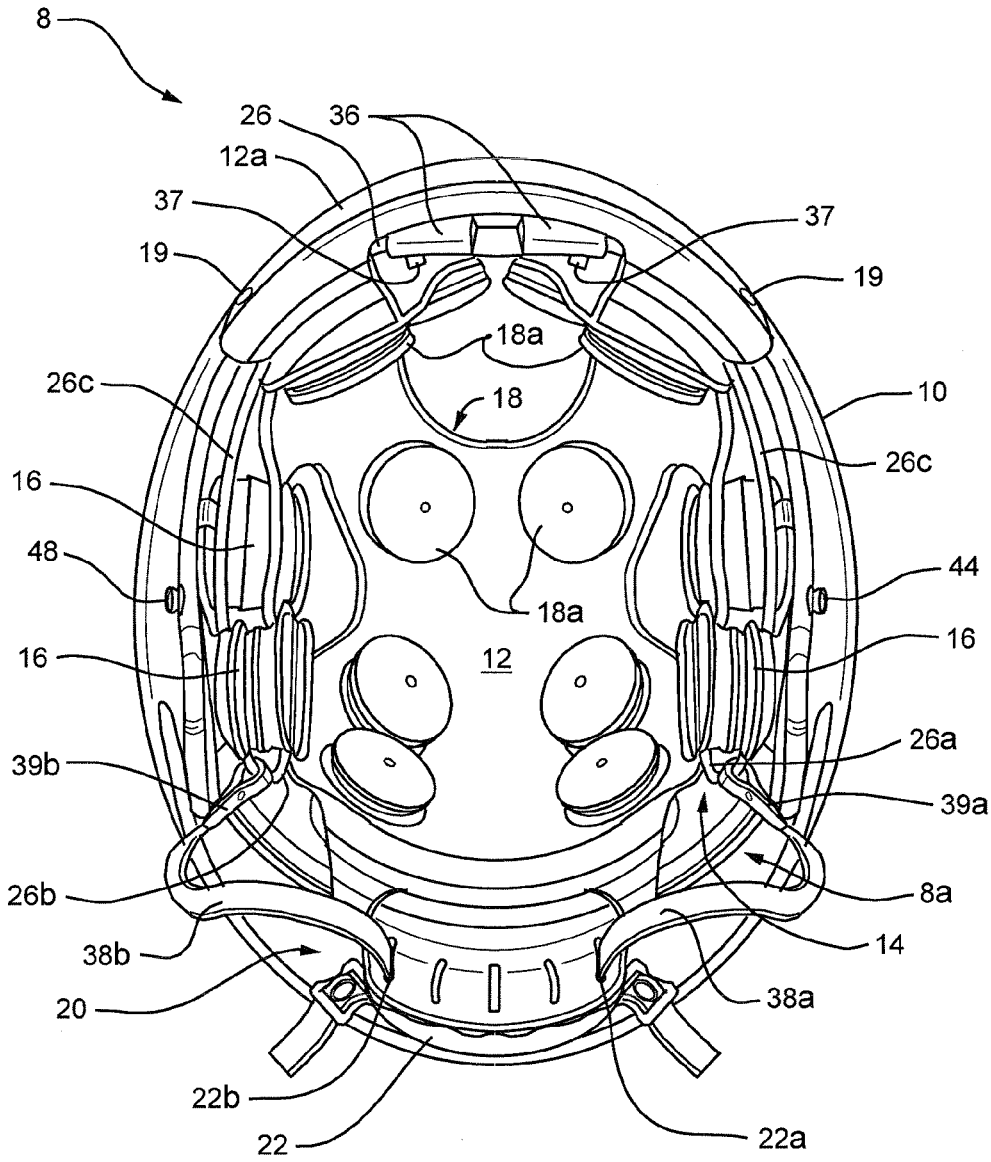
FIG. 3 is a bottom plan view thereof.
Figure 4:
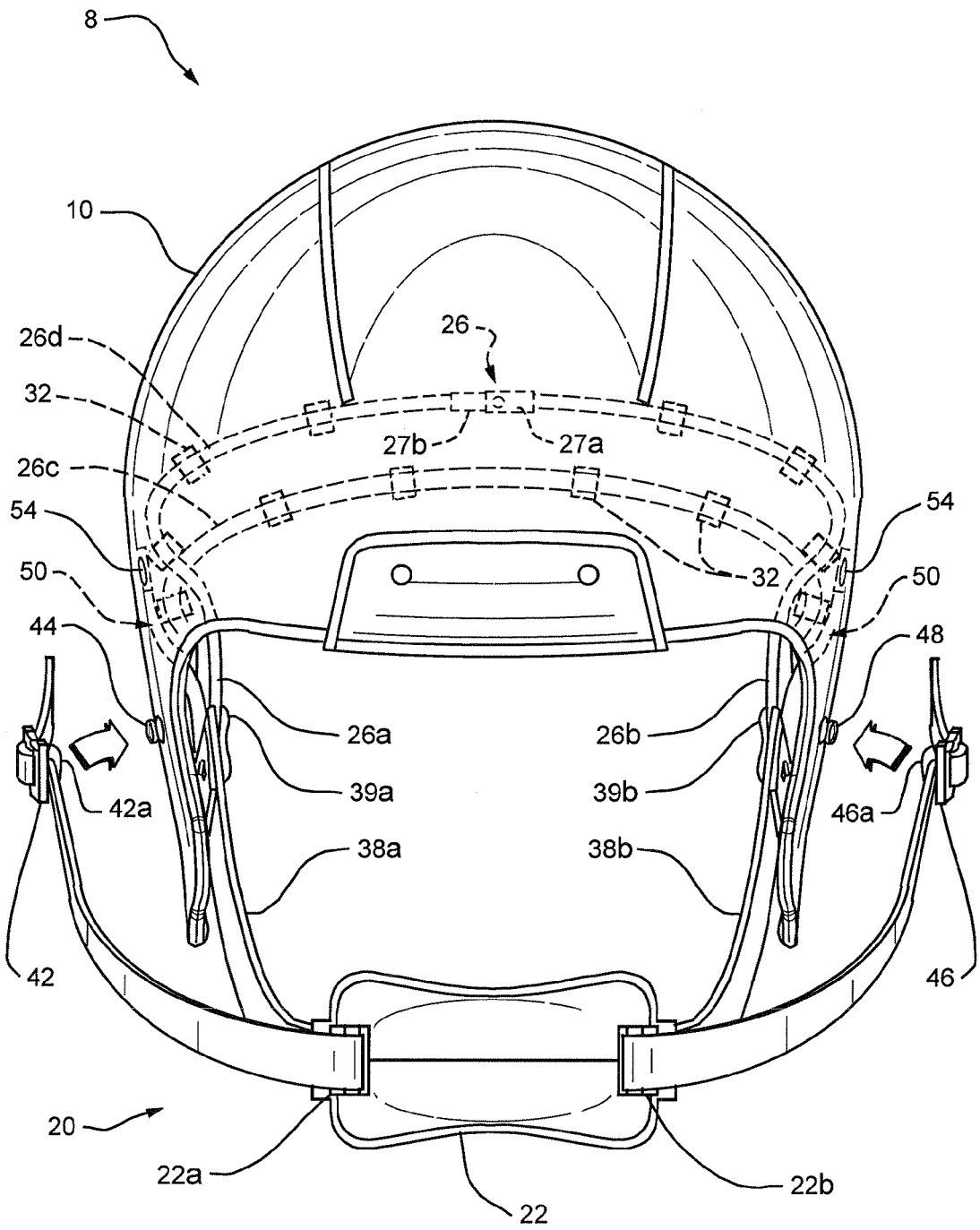
FIG. 4 is a front elevational view thereof.

Referring to FIGS. 2-4, my helmet securement system also includes a tensioning device in the form of a chinstrap assembly indicated generally at 20 which includes a chin protector 22. However, instead of only connecting the chin protector via straps to the helmet outer layer or shell 10 as is done conventionally, strap assembly 20 connects to both the outer layer 10 and indirectly via a belt 26 to the other layers 12 and 14 so that the overall system is especially adapted to snug the helmet inner layer 12 with cells 16 (and liner 18) around the wearer's head.

More particularly, the illustrated belt 26 has opposite ends or eyes 26*a* and 26*b* positioned at opposite sides of the helmet near face opening 8*a*. While the belt may be constituted by a single elongated member, more preferably and as best seen in FIGS. 2 and 4, the belt is in the form of a loop of an inextensible material such as plastic coated wire or nylon filaments. That is, it has a lower stretch or run 26*c* which extends between the helmet layers 10 and 12 and along the sides and back of the helmet adjacent to the lower edge thereof. The belt also includes a corresponding upper stretch or run 26*d*, which is spaced appreciably above run 26*c* so that it is closer to the crown of the helmet 8. Indeed, in some helmets, the upper run 26*d* may actually extend up and over the crown of the inner layer. In any event, the belt runs 26*c* and 26*d* are slidably supported within the helmet outer layer 10 so that when the belt is tensioned by pulling the belt ends 26*a* and 26*b* toward each other and away from the back of the helmet shell 10, the belt stretches 26*c* and 26*d* draw the sides and back of the helmet layers 12 and 14 (and the liner) inward away from shell 10 and toward the center of the helmet. Since the belt run 26*d* is spaced well above the lower edge of the helmet, even the upper portions of those layers (and the liner) are drawn inward away from the outer shell.

As shown in FIG. 4, the belt runs 26*c* and 26*b* are each slidably supported by a plurality of spaced-apart slides or sleeves 32 so that they follow curved courses around layers 12 and 14. For example, slides 32 may be formed in lateral extensions 16' of cells 16 as shown in FIGS. 2 and 6. Some of the slides may be formed in inner layer 12 as shown at 32' in FIG. 2. Some slides may be connected via extensible straps or elastic loops fastened to the inside of helmet outer layer 10 as shown in phantom at 32" in FIG. 5. In any event, for ease of installation, belt loop 26 may be formed as a long cable which may be threaded through the various slides and whose two ends may be connected together by mating connector elements 27*a* and 27*b* as seen at the rear of the helmet in FIG. 4. Thus when the belt 26 is tensioned, it functions more or less as a "purse string" to draw layers 12 and 14 inward away from shell 10.

Referring to FIGS. 2 and 3, the belt 26 may be flexibly secured to outer layer 10 (or layer 12) to prevent excessive translation of the belt. In the illustrated helmet, both the upper and lower runs of belt 26 are encircled by sleeves 36 at the rear of the helmet which are anchored by known fasteners 37, e.g. rivets, screws, etc., to helmet outer layer 10, thus fixing the locations of the belt ends 26*a* and 26*b* at the front of the helmet.

While any device that applies tension to belt 26 may be used on helmet 8, I prefer the chinstrap assembly 20 shown in FIGS. 1 to 4. It includes a pair of similar strap segments 38*a* and 38*b* having corresponding first ends fitted with terminations 39*a* and 39*b* encircling the belt ends 26*a* and 26*b*, respectively. The strap segments extend toward and support the opposite ends of chin protector 22. As best seen in FIG. 4, strap segment 38*a* extends from belt end 26*a* and includes an outgoing segment which passes through an opening 22*a* at one end of chin protector 22 and doubles back via an incoming segment toward the helmet. The free end of the latter segment carries an adjustable buckle 42 which includes a snap fastener element 42*a* that may be snapped onto a mating snap fastener element 44 at the corresponding side of helmet outer layer 10. The strap segment 38*b* likewise extends through an opening 22*b* at the other end of chin protector 22 and loops back via an incoming segment toward the helmet. The free end of strap segment 38*b* carries a similar buckle 46 with a fastener element 46*a* that may be releasably secured to a mating snap fastener element 48 at the other side of helmet 8.

If belt 26 is a single, elongated, strap-like member, the strap segments 38*a*, 38*b* of assembly 20 may constitute integral extensions of that member. In other words, in that event, the belt 26 may extend to the chin protector 20 and be slidably received in the openings 22*a*, 22*b* before looping back to the helmet.

In order to prevent the possible application of excessive tension forces to belt 26 and excessive forward motion of helmet layers 12 and 14 relative to outer shell 10 when the helmet 8 is subjected to strong frontal impacts, it may be desirable to limit the forward movements of the belt ends 26*a* and 26*b*, i.e. movements away from the back of the helmet shell 10. In the illustrated helmet, this is accomplished by the motion limiters 50 provided at opposite sides of the helmet as shown in FIG. 4. The motion limiter 50 at the left side of the helmet is shown in detail in FIG. 5, the limiter at the right side of the helmet being a mirror image thereof.

Figure 5:
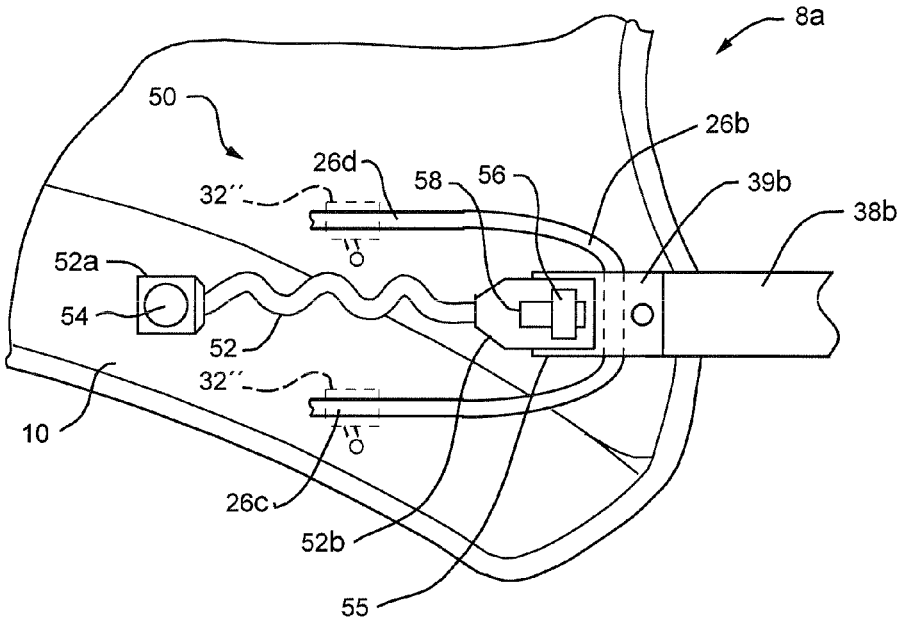
FIG. 5 is a fragmentary elevational view showing the inside of the helmet shell in greater detail.

As shown in FIG. 5, each motion limiter 50 comprises a cable, strap or other elongated member 52 having a fixture 52*a* at one end that is anchored by a fastener 54 to shell 10 at a location well behind the corresponding end of the belt 26, i.e. end 26*b* in FIG. 5. The other end of that member carries a fixture 52*b* that is connected to the belt end 26*b* via the strap element termination 39*b*.

Preferably, to facilitate assembly of my securement system, that connection is a releasable one. For example, the termination 39*b* may have an extension 55 which carries a key 56 which keys into a keyhole 58 formed in fixture 52*b*. When fixture 52*b* is aligned with the extension as shown, the key is locked in the keyhole. When those two parts are rotated 90° relatively, the fixture may be disengaged from the extension.

In any event, the length of member 52 is such that that member is relatively slack during normal use of the helmet. Only when the helmet is subjected to an unusually strong frontal impact does that member 52 become taut, thereby limiting further forward motion of the belt end 26*b*. Thus, both motion limiters 50 act together to limit the forward motion of the helmet layers 12 and 14 relative to outer layer 10.

Once the helmet 8 is on the wearer's head, the helmet may be drawn down on the head and the chin protector 22 urged against the wearer's chin by his pulling the free ends of the two strap segments 38*a* and 38*b* rearwardly and fastening their buckles 42, 46 to the helmet shell 10. These actions will tension the belt 26, which will, in turn, snug the helmet inner layer 12 with the cells 16 and the liner pads 18*a* around the wearer's head and position the chin protector 22 against the wearer's chin.

It will be appreciated that the buckles 42, 46 permit gross adjustments of the respective strap segment lengths to initially set a selected distance between the belt ends and the chin protector 22 when the wearer first uses the helmet. Once those gross adjustments have been made, the buckles may be unfastened from, and refastened to, the helmet shell without any further adjustments of the buckles along their respective strap segments.

The helmet 8 may be removed entirely from the wearer's head after unfastening one or both buckles 42, 46.

Thus, while the helmet is on the user's head, by pulling on one or both of the free ends of the strap segments 38*a*, 38*b*, the chin protector will be drawn against the wearer's chin. Simultaneously, tension will be applied to belt 26 which thereupon draws the inner layer 12 supporting cells 16 and pads 18*a* away from outer layer 10 and toward the top, sides and rear of the wearer's head. In other words, the chinstrap assembly 20 and belt 26 coact with the different layers of the helmet 8 to ensure a proper fit of the helmet to the wearer's head.

Since the wearer needs only to unfasten one buckle in order to don or doff the helmet, one of the strap segments, e.g. segment 38*a*, may be permanently or non-moveably secured between the corresponding ends of the chin protector and belt 26. When fitting the helmet to the wearer for the first time, the length of that segment may be set to center the chin protector in front of the helmet. Thereafter, the pulling back and fastening of the other strap segment 38*b* suffices to tension belt 26 and thus fit the helmet around the wearer's head. Indeed, in some applications, a single adjustable-length strap secured to one end of belt 26 and threaded through openings 22*a* and 22*b* of the chin protector and with its other end releasably fastened to the other end of belt 26 may accomplish most of the invention objectives.

It will thus be seen that the objects set forth above among those made apparent from the preceding description are efficiently attained. Also, since certain changes may be made in the above construction without departing from the scope of the invention it is intended that all matter contained in the above description or shown in the accompanying drawings shall be interpreted as illustrative and not in a limiting sense.

The invention claimed is:

1. A headgear securement system comprising an outer layer having a face opening;

a relatively flexible inner layer within the outer layer, each layer having a front edge, a rear edge and opposite sides;

a middle layer including a plurality of hollow compressible cells mounted to the inner layer;

a first fastening device fastening together the front edges of said layers;

a second fastening device fastening together the rear edges of said layers;

a substantially inextensible belt extending around the inner layer, said belt being secured to the rear edge of the outer layer and having segments extending around the sides of the inner layer substantially to the face opening, and a tensioning device located outside the outer layer and connected to the belt segments for tensioning the belt so as to flex the sides of the inner layer inward away from the outer layer.

2. The system defined in claim 1 wherein said tensioning device includes first and second strap segments constituting extensions of said belt and a tensioner for applying tension to the first and second strap segments.

3. The system defined in claim 1 wherein said belt comprises a closed loop having upper and lower runs positioned at different elevations within the outer layer and said tensioning device is connected to first and second spaced-apart locations on the loop.

4. The system defined in claim 1 wherein the belt has first and second ends located near the face opening and further including motion limiting devices for limiting movements of said belt ends away from said rear edges of the inner and outer layers.

5. The system defined in claim 1 and further including a plurality of spaced-apart slides for supporting said belt segments, each slide being connected to one or another of said layers.

6. The system defined in claim 5 wherein at least some of the slides are connected to different ones of the cells.

7. A headgear securement system comprising an outer layer having a face opening;

a relatively flexible inner layer within the outer layer, each layer having a front edge, a rear edge and opposite sides;

a first fastening device fastening together the front edges of said layers;

a second fastening device fastening together the rear edges of said layers;

a substantially inextensible belt extending around the inner layer, said belt being secured to the rear edge of the outer layer and having segments extending around the sides of the inner layer substantially to the face opening, and a tensioning device located outside the outer layer and connected to the belt segments for tensioning the belt so as to flex the sides of the inner layer inward away from the outer layer, wherein said tensioning device includes first and second strap segments constituting extensions of said belt, a tensioner for applying tension to the first and second strap segments, and the first and second strap segments and the tensioner comprise an adjustable chinstrap assembly.

8. A headgear securement system comprising an outer layer having a face opening;

a relatively flexible inner layer within the outer layer, each layer having a front edge, a rear edge and opposite sides;

a first fastening device fastening together the front edges of said layers;

a second fastening device fastening together the rear edges of said layers;

a substantially inextensible belt extending around the inner layer, said belt being secured to the rear edge of the outer layer and having segments extending around the sides of the inner layer substantially to the face opening, and a tensioning device located outside the outer layer and connected to the belt segments for tensioning the belt so as to flex the sides of the inner layer inward away from the outer layer, wherein said belt comprises a closed loop having upper and lower runs positioned at different elevations within the outer layer, said tensioning device is connected to first and second spaced-apart locations on the loop, said inner layer has a crown and said upper run extends around said opposite sides and crown of the inner layer.

9. A headgear securement system comprising an outer layer having a face opening;

a relatively flexible inner layer within the outer layer, each layer having a front edge, a rear edge and opposite sides;

a first fastening device fastening together the front edges of said layers;

a second fastening device fastening together the rear edges of said layers;

a substantially inextensible belt extending around the inner layer, said belt being secured to the rear edge of the outer layer and having segments extending around the sides of the inner layer substantially to the face opening, and a tensioning device located outside the outer layer and connected to the belt segments for tensioning the belt so as to flex the sides of the inner layer inward away from the outer layer, and wherein said belt comprises a closed loop having upper and lower runs positioned at different elevations within the outer layer, said tensioning device is connected to first and second spaced-apart locations on the loop and the loop is composed of a single strand having opposite ends and mating connectors affixed to said ends.

10. A headgear securement system comprising an outer layer having a face opening;

a relatively flexible inner layer within the outer layer, each layer having a front edge, a rear edge and opposite sides;

a first fastening device fastening together the front edges of said layers;

a second fastening device fastening together the rear edges of said layers;

a substantially inextensible belt extending around the inner layer, said belt being secured to the rear edge of the outer layer and having segments extending around the sides of the inner layer substantially to the face opening, and a tensioning device located outside the outer layer and connected to the belt segments for tensioning the belt so as to flex the sides of the inner layer inward away from the outer layer, wherein said belt comprises a closed loop having upper and lower runs positioned at different elevations within the outer layer, said tensioning device is connected to first and second spaced-apart locations on the loop and the tensioning device comprises a chinstrap assembly including a chin protector having opposite ends, a first strap segment extending from the first location on the loop to one end of the chin protector, a second strap segment extending from the second location on the loop to the opposite end of the chin protector, and a buckle for adjusting the length of at least one of the first and second strap segments.

11. The system defined in claim 10 and further including first and second motion limiters adjacent to said opposite sides which limit movement of said first and second locations on the belt loop away from said rear edges of the inner and outer layers.

12. The system defined in claim 11 wherein each of the said first and second motion limiters comprises an elongated, normally relatively slack member connected between each location on the loop and said outer layer.

13. The system defined in claim 12 wherein the connection of each slack member to the associated loop location is a releasable connection.

14. A headgear securement system comprising an outer layer having a face opening;

a relatively flexible inner layer within the outer layer, each layer having a front edge, a rear edge and opposite sides;

a first fastening device fastening together the front edges of said layers;

a second fastening device fastening together the rear edges of said layers;

a substantially inextensible belt extending around the inner layer, said belt being secured to the rear edge of the outer layer and having segments extending around the sides of the inner layer substantially to the face opening, and a tensioning device located outside the outer layer and connected to the belt segments for tensioning the belt so as to flex the sides of the inner layer inward away from the outer layer, said belt having first and second ends located near the face opening and motion limiting devices for limiting movements of said belt ends away from said rear edges of the inner and outer layers, said limiting devices each comprising a normally relatively slack member connected between the associated end of the belt and said outer layer.

15. The system defined in claim 14 wherein the connection of each slack member to the associated belt end is a releasable connection.

16. A headgear securement system comprising an outer layer;

a relatively flexible inner layer;

a middle layer including a plurality of compressible cells mounted to the inner layer;

an inner liner composed of a plurality of resilient members, each resilient member being positioned opposite a different one of the compressible cells of the middle layer;

a relatively inextensible belt extending around the inner layer within the outer layer, and a tensioning device connected to the belt and which tensions the belt so as to flex the inner layer inward away from the outer layer.

17. Protective headgear for positioning on a wearer's head, said headgear comprising an outer layer having a face opening;

a relatively flexible inner layer within the outer layer, each layer having a front edge, a rear edge and opposite sides;

a first fastening device fastening together the front edges of said layers;

a second fastening device fastening together the rear edges of said layers;

a substantially inextensible belt extending around the inner layer, said belt being secured to the rear edge of the outer layer and having segments extending around said sides of the inner layer to first and second ends located near the face opening, and a chinstrap assembly including a chin protector having opposite ends, a first strap having one end extending from the first end of the belt to one end of the chin protector and a second strap extending from the second end of the belt to the opposite end of the chin protector, said straps being slidably connected to the corresponding ends of the chin protector and having free ends which when pulled back toward the outer layer will draw the chin protector against the wearer's chin and snug the inner layer toward the wearer's head by tensioning the belt.

18. The headgear defined in claim 17 wherein the belt comprises a closed loop having upper and lower runs slidably supported by a plurality of spaced-apart slides connected to one or the other of said layers.

19. The headgear defined in claim 18 and further including fastening devices for fastening the free ends of said straps to said outer layer.

20. The headgear defined in claim 19 wherein the fastening devices include buckles adjustably positioned on said straps adjacent to the free ends thereof, and fasteners for fastening the buckles to the opposite sides of said outer layer.

* * * * *